US006197135B1

(12) United States Patent
Monte et al.

(10) Patent No.: US 6,197,135 B1
(45) **Date of Patent: *Mar. 6, 2001**

(54) ENHANCED ENERGETIC COMPOSITES

(75) Inventors: Salvatore J. Monte, Staten Island, NY (US); Gerald Sugerman, Allendale, NJ (US)

(73) Assignee: Kenrich Petrochemicals, Inc., Hudson, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 06/841,471

(22) Filed: Feb. 18, 1986

(51) Int. Cl.[7] ..... C06B 45/10

(52) U.S. Cl. ..... 149/19.2; 149/19.1; 149/19.4; 149/19.91; 149/19.9

(58) Field of Search ..... 149/19.1, 19.2, 149/19.9, 19.91; 179/19.8, 19.4

(56) References Cited

U.S. PATENT DOCUMENTS 3,167,525 * 1/1965 Thomas ..... 149/19.2
3,637,444 * 1/1972 Bonyata et al. ..... 149/10
3,907,619 * 9/1975 Elrick ..... 149/98
3,932,353 * 1/1976 Mastrolia et al. ..... 149/19.2
4,050,968 * 9/1977 Goldhagen et al. ..... 149/19.91
4,051,207 * 9/1977 Brachert et al. ..... 149/100
4,139,404 * 2/1979 Goddard et al. ..... 149/19.2
4,260,437 * 4/1981 Nakagawa et al. ..... 149/19.9
4,352,700 * 10/1982 Hoffman ..... 149/19.2
4,354,884 * 10/1982 Williams ..... 149/10
4,597,924 * 7/1986 Allen et al. ..... 149/19.91
4,713,127 * 12/1987 Muller et al. ..... 149/98
4,985,094 * 1/1991 Nahlovsky et al. ..... 149/19.9

* cited by examiner

*Primary Examiner*—Edward A. Miller
(74) *Attorney, Agent, or Firm*—Darby & Darby

(57) ABSTRACT

The instant invention relates to the use of certain selected neoalkoxy organo-titanates and organo-zirconates in energetic compositions to improve their processability, physical properties, and combustion properties. The organo-titanates and organo-zirconates of the instant invention, when added to the energetic systems' matrix in advance of the introduction of particulate or other solid energetic components, improve the dispersion of the latter while reducing the energy required to achieve formulation uniformity. This enhances the processability, the physical properties, the burn characteristics and the safety and handling characteristics of the formulated composites.

8 Claims, No Drawings

ENHANCED ENERGETIC COMPOSITES

BACKGROUND OF THE INVENTION

Energetic composites are conventionally composed of a solid oxidizer dispersed within and bonded by a fuel matrix. The fuel matrix may optionally contain additional components such as powdered metals which act as high energy fuel and minor amounts of special purpose additives, plasticizers, antioxidants, wetting agents, curatives, and reinforcing and bonding agents.

For optimum results, each non-soluble composite component should be uniformly dispersed to a discrete small particle size in order to assure maximum energy conversion. Typically, it is advantageous to maximize the level of oxidizer and high energy fuel components while minimizing the level of binder component since most binder materials are poorer specific energy generators. Typically, additives such as plasticizers, antioxidants and wetting agents are introduced primarily to enhance the processability or the stability of the binder component of the system. Therefore, a reduction in the level of binder further reduces the need for these low energy components with consequent significant improvement in performance of the composite. Since, generally, the minimum amount of binder is determined by processability, this factor is one of the primary limitations on the performance of an energetic composite.

Various related formulations using metallo-organic compounds, especially aluminum III alkoxylates, monoalkyl silicon IV tris alkoxylates and monoalkoxy titanium IV tris salts of various types, when employed in modest proportions, have been shown to improve processability of a variety of composites. The titanate salts, particularly, are effective in enhancing dispersion of inorganic particulate in organic matrix binders such as those conventionally employed as matrices for energetic compositions.

BRIEF DESCRIPTION OF THE INVENTION

It has now been surprisingly found that neoalkoxy titanium IV and zirconium IV tris salts, most particularly those of the bis ester phosphate and pyrophosphate type, are not only effective processability enhancers but that, when used in proportions of the order from 0.01 to 5%, and more preferably from 0.1 to 2% of the total formulation (exclusive of volatile solvents and/or inert carrier materials), they will provide enhanced composite physical properties, reduced burn rates and greater product uniformity (resulting in enhanced handling safety) and less pressure sensitivity as compared to the prior art. In the energetic formulations tested, the addition of the additives of the instant invention provided positive rheological benefits, specifically a tendency toward Newtonian flow behavior, and an increase in critical particulate solids volume capabilities, thereby increasing inherent specific energy possible at constant formulation viscosity. The organo-titanate additives, surprisingly, reduce burn rate significantly, whereas the corresponding organo-zirconium derivatives have the reverse effect as compared to control experiments.

Solid propellants are conventionally composed of finely divided inorganic oxidizer material; organic resin which may serve as both a fuel and a binder; additional powdered metals which provide additional combustible material; and minor amounts of other additives such as plasticizers, antioxidants, wetting agents, curatives, metal oxides, and reinforcing agents.

Generally speaking, oxidizers are powdered and vary in size broadly from 1 to 300 microns average particle size, preferably in the range of from 20 to 200 microns. These materials form the major portion of the total composition, generally ranging from 65 to 95% of the total mixture. The fuel binder is usually present in minor proportions of the total composition, generally ranging from 5 to 35% by weight. Generally, it is advantageous to reduce the amount of binder material which is present, since such material adds weight to the total charge and its energy generation per unit weight is less than that provided by powdered metal fuels. The foregoing compositional factors are conventional to the art and described in detail in U.S. Pat. No. 3,050,423.

DETAILED DESCRIPTION OF THE INVENTION

It is preferred to admix in situ the organo-metallics of the instant invention with a fluid component of the matrix in advance of introduction of particulate for best results. It is also possible to pretreat particulate solids with the additives before introduction into the matrix material. However, additive pretreatment increases processing cost and handling hazards as compared to the in situ techniques. The methods of mixing of the energetic components and additives is known to those skilled in the art. Extruders or batch units such as the common sigma blade, ribbon blender, vertical two blade planetary, or other medium shear mixers, all preferably jacketed and equipped with heating and cooling capabilities external to the mixing bowl, may be used. Such equipment minimizes the potential for thermal runaway and permits the adjustment and control of process temperatures during the mixing operation. The objective of the mixing procedure is to fully wet and deagglomerate the oxidizer and optional energetic fuel particulate in the fluid binder at processing temperatures in order to maximize product uniformity and dispersion. Generally, after mixing, the resultant formulation is formed into the desired shape prior to use as an energetic composite. The forming can be achieved via a variety of well-known technologies including, but not limited to, casting, impregnation, extrusion, and tableting. The objective is to provide a viable, relatively easy to handle product which can be used as a source of energy for rocketry, ballistic propulsion, explosives, fuse materials, chemical welding and the like.

Current propellant binder systems include, but are not limited to, polybutadiene acrylic acid (PBAA), polybutadiene acrylic acid acrylonitrile (PBAN), carboxyl terminated polybutadiene (CTPB), hydroxyl terminated polybutadiene (HTPB), polysulfides, polyether urethanes, polyester urethanes, unsaturated polyesters and acrylics, epoxies, and nonreactive binders such as polyvinyl chloride (PVC), and nitrocellulose (NC) plastisols.

In all cases, the polymeric compound "binds" all propellant ingredients to form an aggregate or composite of sufficient strength to withstand the thermal and mechanical loads of motor operation and vehicle flight.

The neoalkoxy compounds of this invention may be used to advantage in most propellant binders. Positive effects are observed in the carboxyl terminated butadienes with a total absence of the cure rate problems normally associated with CTPB binders.

Where polyurethane systems are employed, it is useful to prepare a two-part system consisting of a premixed polyol part which contains the majority of the ingredients and a curative part which is composed primarily of the isocyanate curative. Such techniques will be readily understood by those skilled in the art.

Other elastomers which may be used as the binder are hydroxyl terminated butadiene prepolymers such as R45HT made by Arco Chemical Co. and having a functionality of about 2.7. These are described in U.S. Pat. No. 3,932,240.

The quantity of the particular neoalkoxy compound selected is dependent to a large degree on the proportion of and physical size of the propellant particles being employed, and the chemistry of the additive is determined by the nature of the matrix and effects desired. For example, while the pyrophosphates are found to be outstandingly effective in reducing the burn rate exponent, in urethane systems they produce the side effect of decreasing the cure rate of the resin, which may prove advantageous in large coatings as a means of thermal stress control. The organo-phosphates, on the other hand, have substantially no effect on the cure rate of two component urethanes.

When titanates are used as bonding agents, their catalytic effects on the NCO/OH cure reaction of the propellant binder system can be controlled by treating the aluminum or ammonium perchlorate with a solvent solution of the titanate and subsequently drying the treated particles. This procedure eliminates free titanate by allowing only enough titanate to produce the desired monolayer on the surface of the solid particles. Since the monolayer is tightly bound to the solid particles, and no excess titanate is present, very little subsequent effect on cure rate of the propellant is observed. A less selective, but more economical and still useful approach, is that of blending the titanate and the isocyanate prior to their addition to the rubber portion of the propellant binder.

In order to define more clearly the instant invention, attention is directed towards the following examples.

EXAMPLE 1

Evaluation of the Effects of Various Organometallic Coupling Agents in a Polyurethane Bound Aluminum-Ammonium Perchlorate Based Propellant The following propellant formulations (Formulations Control and Ia-Im) were mixed by adding the listed components in the order indicated (the ammonium perchlorate was added incrementally in 10% aliquots) while maintaining mix temperatures at 65+5° C. throughout via external heating/cooling using a planetary type vertical vacuum mixer with Teflon coated blades. Mix viscosity was measured within ten minutes of the end of the two hour mixing regimen using an orifice type viscometer at 65+2° C. Samples were compression molded @ 80° C. for 24 hrs., cooled, die cut and equilibrated for 24 hrs. at 25° C. prior to physical testing. Results are given in Tables 1A and 1B.

| Formulation 1 | Parts By Weight |
|---|---|
| Hydroxy terminated polybutadiene (HTPB) | 6.8 |
| Dimethyl glutarate (DMG) + coupling agent[1] | 2.0 |
| Isophorone diisocyanate | 1.2 |
| Ferrocene | 0.2 |
| Tetrakis aziridino methane | 0.1 |
| Carbon black | 0.1 |
| Aluminum powder - 325 mesh | 9.6 |
| Ammonium perchlorate powder - 325 mesh | 80.0 |
| | 100.00 |

[1]Coupling agent as shown 15 wt. percent (0.3) in DMG equilibrated for 48 hours prior to usage. Coupling agents used:
a) Aluminum IV trisoctadecanolato
b) Silicon IV methyl tris methanolato
c) Titanium IV 2-propanolato, tris(diisooctyl) phosphato-O
d) Titanium IV 2-propanolato tris(butyl methyl) pyrophosphato-O -continued

| Formulation 1 | Parts By Weight |
|---|---|
| e) Titanium IV (2,2-bis 2-propenolatomethyl) butanolato tris neodecanoato-O | |
| f) Titanium IV (2,2-bis 2-propenolatomethyl) tris(diisooctyl) phosphato-O | |
| g) Titanium IV (2,2-bis 2-propenolatomethyl) tris (dimethyl) pyrophosphato-O | |
| h) Titanium IV (2-propanolato, 2-propenolato) butanolato tris diisooctyl phosphato-O | |
| j) Titanium IV (2-propenolato, 2-propenolato) butanolato tris(diisooctyl) pyrophosphato-O | |
| k) Titanium IV (2-methyl, 2-phenyl) propanolato tris(dibutyl) phosphato-O | |
| l) Zirconium IV (2,2-bis 2-propenolatomethyl) butanolato, tris(diisooctyl) phosphato-O | |
| m) Zirconium IV 2,2-bis 2-propenolatomethyl) butanolato, tris diisooctyl pyrophosphato-O | |

TABLE 1A

Effect of Coupling Agent on (2 Hour) Mix Viscosity

| Coupling Agent | Mix Viscosity × $10^6$ Poise |
|---|---|
| None | 130 ± 12 |
| a | 116 ± 9 |
| b | 105 ± 12 |
| c | 62 ± 4 |
| d | 59 ± 4 |
| e | 21 ± 2 |
| f | 3.4 |
| g | 5.9 |
| h | 3.7 |
| j | 6.4 |
| k | 11.6 |
| l | 57.4 |
| m | 81.3 |

TABLE 1B

Tensile Properties of Cured Aluminum/Ammonium Perchlorate Filled IPDI/HTPB Elastomer (Formula 1)

| Coupling Agent | Maximum Tensile Strength $10^2$ psig | Elongation at Yield % |
|---|---|---|
| a | 3.2 | 4 |
| b | 3.3 | 3 |
| c | 4.2 | 7 |
| d | 4.7 | 7 |
| e | 5.4 | 11 |
| f | 5.8 | 12 |
| g | 6.2 | 17 |
| h | 5.7 | 14 |
| j | 6.4 | 16 |
| k | 5.2 | 14 |
| l | 5.3 | 12 |
| m | 6.0 | 16 |

The aforegoing mix viscosity (rheology) data and cured elastomer physical property data clearly establish the superiority of neoalkoxy titanium and zirconium coupling agents (e,f,g,h,j,k) and (l,m), respectively vs. the prior art aluminum, silicon, and non-neoalkoxy titanium based coupling agents. It should also be noted that these data established a preference for neoalkoxy titanium phosphates and pyrophosphates as rheology enhancers and for neoalkoxy titanium and zirconium pyrophosphates as tensile property enhancers in this system.

Test firings of 3×40 cm cylindrical charges of Formulation I have shown that the versions including coupling agents f, h, k and l have produced substantially more uniform, less pressure sensitive burn rates than is possible by use of the other additive tested. Accordingly, enhanced rocket projectile control may be obtained when these neoalkoxy metallo phosphates are employed as coupling agents in polyurethane bound aluminum/perchlorate filled energetic systems.

EXAMPLE 2

Dispersions of nitroguanidine (NG)(200–300 mesh) powder in polyethylene glycol 2000 (PEG) were prepared by incremental addition over 2 hours of the NG to 20 pbw of PEG solution containing 2 pbw of the indicated coupling agent at 50+2° C. The maximum loading of nitroguanidine consistent with melt cohesivity under 1.5 rpm shear rate using a Brookfield H V T viscometer was then measured at 50+2° C. after a 30 minute post mix. The results are given in Table 2A.

TABLE 2A

Effect of Various Coupling Agents on Melt Cohesion (Melt Fracture Resistance) of NG-PEG Formulations

| Coupling Agent | Maximum Allowable NG Loading Wt. Percent |
|---|---|
| None | 57 |
| a | 61 |
| b | 52 |
| c | 67 |
| d | 71 |
| e | 78 |
| f | 76 |
| g | 77 |
| h | 81 |
| j | 78 |
| k | 76 |
| l | 74 |
| m | 75 |

Formulations of NG at a constant loading of 55% NG in PEG containing various coupling agents were prepared and 10 gram pellets of approximate dimensions 3×3 cm (cylinders) subjected to drop weight impact tests to determine ease of detonation at 25° C. and 50% relative humidity. The results are tabulated in Table 2B.

TABLE 2B

Effect of Various Coupling Agents on the Drop Weight Impact Detonation Resistance of NG-PEG Dispersions at 55 pbw NG and 0.45 pbw Coupling Agent Concentrations, Respectively

| Coupling Agent | Impact Required for Detonation × $10^3$ PSI |
|---|---|
| None | 2.3 ± 0.5 |
| a | 2.0 ± 0.5 |
| b | 2.1 ± 0.5 |
| c | 2.9 ± 0.2 |
| d | 2.7 ± 0.2 |
| e | 2.5 ± 0.2 |
| f | 3.4 ± 0.2 |
| g | 4.2 ± 0.2 |
| h | 3.5 ± 0.2 |
| j | 4.4 ± 0.2 |
| k | 3.3 ± 0.2 |
| l | 2.7 ± 0.2 |
| m | 2.9 ± 0.2 |

The aforegoing clearly establish the efficacy of the neoalkoxy Titanium IV and Zirconium IV coupling agents vs. the prior art with respect to the enhancement of processability and reduction of impact sensitivity of polyethylene glycol bound nitroguanidine energetics. Since the energy release density from such dispersions is a supralinear function of NG concentration, the neoalkoxy Titanium IV and Zirconium IV coupling agents of the instant invention will, therefore, permit more efficient energy compositions to be produced in the NG-PEG system than were heretofore practicable from both process and safety limitation viewpoints.

EXAMPLE 3

A solution of 0.8 pbw of the indicated additive in a 90:10 mixture of trinitrotoluene (TNT) and dinitrotoluene (DNT) was prepared by maintaining the DNT-additive mixture in an externally heated Teflon container at 90° C. (fluorocarbon oil bath) during the addition of TNT. When the resulting solution reached thermal equilibrium (approximately 40 minutes) a 1:1 mixture of HMX:RDX (−200 mesh) was added in small incremental proportions and mixed in with a 5 rpm vertical planetary type Teflon coated stirrer. In each case, the HMX:RDX blend was continually stirred until the mix viscosity reached 10 kps after which addition was terminated. The resulting dispersions were cooled to 20° C. over 4 hrs., weighted to determine particulate loading, and examined for matrix stress cracking. The results of this investigation are tabulated in Table 3.

TABLE 3

Effect of Various Additives on the Characteristics of HMX:RDX Dispersions in Plasticized TNT

| Coupling Agent | Max. Loading Allowable HMX:RDX pbw | Naked Eye Visible Stress Cracks Number/Size After Cooling |
|---|---|---|
| None | 38–43 | Numerous/Large |
| a | system unstable-results erratic | |
| | 29–42 | Numerous/Very Large |
| b | 40–45 | Numerous/Moderate |
| c | 49–52 | Numerous/Modest |
| d | 46–50 | Numerous/Modest |
| e | 54–56 | Few/Modest |
| f | 59–61 | Very Few/Small |
| g | 51–53 | Few/Small |
| h | 58–60 | None Visible |
| j | 53–55 | Few/Small |
| k | 60–62 | None Visible |
| l | 46–49 | Few/Small |
| m | 44–48 | Few/Modest |

This example teaches the utility of employing the additives of the instant invention in the production of high assay hexamethylene bexanitramine (HMX)/tetramethylene tetranitramine (RDX) dispersions in a plasticized trinitrotoluene (TNT) matrix of superior cohesivity.

The above data clearly demonstrate the superiority of the additives of the instant invention as compared to the prior art with respect to their performance as dispersants and stress relievers in the HMX:RDX:TNT:DNT system. These enhancements are incompletely understood but probably involve surface modification of the energetic particulate producing reduced matrix absorption, rheological enhancement and improved bonding, thereby minimizing stress cracking or matrix crystallization.

EXAMPLE 4

A solution of 10 pbw of nitrocellulose (D-S 2.3 Mw 950) in 44.6 pbw each of methylethyl ketone and amyl nitrate was prepared by maintaining a dispersion of said resin in the indicated solvent at 40° C. for 2 days with intermittent mixing 0.8 pbw of the indicated coupling agent was added and a closely woven 30 denier jute fiber was drawn vertically through the above solution at a rate of one foot/minute, followed by vacuum drying of the impregnated fiber at 80°

C. and 2.5 mm Hg. The resultant dried impregnated fiber was equilibrated at 25° C. and 50% relative humidity for 48 brs. prior to weighing (to evaluate NC uptake and subsequent burn rate evaluation.) The results are given in Table 4.

TABLE 4

Weight Gain and Burn Rate Evaluation of Jute Fiber Impregnated with NC Solution Containing Various Coupling Agents

| Coupling Agent | % Wt. Gain on Fiber | Horizontal Burn Rate cm/min. | Burn Characteristics |
|---|---|---|---|
| None | 21 ± 3 | 16 ± 4 | Burns Erraticly |
| a | 24 ± 3 | 15 ± 3 | Burns Erraticly |
| b | 22 ± 3 | 16 ± 4 | Burns Erraticly |
| c | 25 ± 2 | 12 ± 3 | Burns Erraticly |
| e | 29 ± 2 | 10 ± 1 | Burns Smoothly |
| f | 30 ± 2 | 11 ± 1 | Burns Smoothly |
| g | 29 ± 2 | 10 ± 1 | Burns Smoothly |
| l | 24 ± 2 | 21 ± 2 | Burns Smoothly |
| m | 25 ± 2 | 23 ± 1 | Burns Smoothly |

The data in Table 4 suggest that both the neoalkoxy titanates and neoalkoxy zirconates of the present invention enhanced NC pickup by the jute fiber, possibly via enhancement of wetting or penetration of the NC solution, and improved the uniformity of burn as compared with the prior art. On the other hand, they acted in a dimetrically opposed way with respect to burn rate modification. The neoalkoxy titanates slowed burn rate and the neoalkoxy zirconates enhanced the burn rate as compared to the prior art, despite the substantially greater NC pickup effected by the titanate analogs. This effect is surprising because of the reverse of the expected direct dependence of burn rate on NC pickup. This indicates that the coupling agents of the instant invention have a direct effect or effects on the composite's combustion rate process or processes, i.e., that the neoalkoxy zirconates act as catalysts and the neoalkoxy titanates as retarders, respectively.

We claim:

1. A composition of matter comprising a dispersion of a solid oxidizer within and bonded by a fuel matrix which is polybutadiene acrylic acid, polybutadiene acrylic acid acrylonitrile, carboxyl terminated polybutadiene, hydroxyl terminated polybutadiene, polysulfide, polyether urethane, polyester urethane, unsaturated polyester, acrylic, epoxy or polyvinyl chloride containing from about 0.01 to 5 wt. % of a coupling agent having the formula $R_1R_2R_3CCH_2OM(X)_3$, wherein:

each R is independently selected from saturated or unsaturated, linear or branched monovalent hydrocarbon based ligands having from 1 to 24 carbon atoms and optionally containing up to 2 aromatic rings and/or up to 4 ether-oxygen substituents;

M is zirconium IV or titanium IV;

each X is independently selected from monovalent, saturated or unsaturated, linear or branched carboxylates having from about 2 to 24 carbon atoms and optionally containing up to 2 aromatic rings and/or 2 ether-oxygen substituents; and saturated or unsaturated, linear or branched diester phosphates or pyrophosphates, each ester of which has from about 1 to 20 carbon atoms and optionally containing up to 2 aromatic rings and/or 2 ether-oxygen substituents.

2. The composition of matter of claim 1 wherein the solid oxidizer is aluminum powder, ammonium perchlorate, nitroguanidine, trinitrotoluene, dinitrotoluene, nitrocellulose, or mixtures thereof.

3. The composition of matter of claim 1 wherein $R_1$, $R_2$ and $R_3$ are methyl groups.

4. The composition of matter of claim 1 wherein X is a decanoate.

5. The composition of matter of claim 1 wherein X is a dibutyl or dioctyl phosphate or pyrophosphate group.

6. The composition of matter of claim 1 wherein from 65 to 95 wt. % of the oxidizer and from 5 to 35 wt. % of the fuel matrix are present.

7. The composition of matter of claim 1 wherein the dispersion contains from about 0.1 to 2 wt. % of the coupling agent.

8. The composition of matter of claims 1 or 7 wherein the dispersion contains one or more of the components selected from powdered metals, plasticizers, antioxidants, wetting agents, curatives, bum modifiers, reinforcing agents, bonding agents, and inert fillers.

* * * * *